US006135042A

United States Patent [19]

Hollenstein

[11] Patent Number: 6,135,042

[45] Date of Patent: Oct. 24, 2000

[54] SAILING CRAFT

[76] Inventor: Ray Hollenstein, 11702 E. Manana, Cove Creek, Ariz. 85331

[21] Appl. No.: 09/060,945

[22] Filed: Apr. 15, 1998

[51] Int. Cl.[7] ..... B63B 1/00

[52] U.S. Cl. ..... 114/61; 114/345; 114/354

[58] Field of Search ..... 280/62; 180/2.2; 114/39.1, 61, 352, 354, 344, 345, 270

[56] References Cited

U.S. PATENT DOCUMENTS

| | | | |
|---|---|---|---|
| 299,317 | 5/1884 | Aspinwall | 180/2.2 |
| 2,238,464 | 4/1941 | Fletcher | 114/39 |
| 2,958,306 | 11/1960 | Haxton et al. | 114/354 |
| 4,688,504 | 8/1987 | Sulz et al. | 114/39 |
| 4,825,790 | 5/1989 | Strout | 114/39.1 |
| 4,829,925 | 5/1989 | Haanen | 114/39.1 |
| 4,915,047 | 4/1990 | Lord et al. | 114/39.1 |
| 4,945,845 | 8/1990 | Johnson, Jr. | 114/39.1 |
| 5,492,074 | 2/1996 | Lekhtman | 114/39.1 |

*Primary Examiner*—Ed L. Swinehart
*Attorney, Agent, or Firm*—Joseph N. Breaux

[57] ABSTRACT

A sailing craft that includes an elongated central tubular frame structure, a left outrigger assembly attached to the forward left side of the central tubular frame structure, a right outrigger assembly attached to the forward right side of the central tubular frame structure, a rudder steering assembly pivotally mounted to the rear center of the tubular frame structure, a left sail supported by the left outrigger assembly, a right sail supported by the right outrigger assembly, and a seat assembly secured to the rearward end of the central tubular frame structure.

12 Claims, 3 Drawing Sheets

SAILING CRAFT

TECHNICAL FIELD

The present invention relates to wind powered craft and more particularly a sailing craft including an elongated central tubular frame structure, a left outrigger assembly attached to the forward left side of the central tubular frame structure, a right outrigger assembly attached to the forward right side of the central tubular frame structure, a rudder steering assembly pivotally mounted to the rear center of the tubular frame structure, a left sail supported by the left outrigger assembly, a right sail supported by the right outrigger assembly, and a seat assembly secured to the rearward end of the central tubular frame structure; the left outrigger assembly including a tubular left outrigger framework, a left mast member secured to the tubular left outrigger framework, a left inflatable outrigger tube attached to the tubular left outrigger framework, and a left rotating skag wheel rotatably mounted within the opening of the left inflatable outrigger tube; the right outrigger assembly including a tubular right outrigger framework, a right mast secured to the tubular right outrigger framework, a right inflatable outrigger tube attached to the tubular right outrigger framework, and a right rotating skag wheel rotatably mounted within the opening of the right inflatable outrigger tube; the rudder steering assembly including a rudder control arm and a circular rudder keel board rotatably mounted in a pivoting keel board fork assembly, the pivoting keel board fork assembly being in pivotal connection with the central tubular frame structure; the left sail being secured to the left mast; the right sail being secured to the right mast; the seat assembly including a seat, a tubular seat assembly frame, an inflatable seat assembly tube secured to the tubular seat assembly frame, and a pivoting rotating seat assembly rudder wheel used for steering rotatably mounted within an opening of the inflatable seat assembly tube; the left rotating skag wheel, the right rotating skag wheel and the seat assembly rudder wheel rotating about parallel axises; the left rotating skag wheel having a portion thereof extending down past the left inflatable outrigger tube; the right rotating skag wheel having a portion thereof extending down past the right inflatable outrigger tube; the seat assembly rudder wheel having a portion thereof extending down past the inflatable seat assembly tube; the left outrigger framework having a front portion oriented at an angle of between one-hundred-twenty and one-hundred-fifty degrees with respect to a rear portion thereof; the right outrigger framework having a front portion oriented at an angle of between one-hundred-twenty and one-hundred-fifty degrees with respect to a rear portion thereof.

BACKGROUND ART

Many individuals enjoy piloting sail powered vehicles on land as well as water. It would be a benefit, therefore, to have a sailing craft that included support mechanisms for allowing the sailing craft to be piloted over land and on water. It would of course be a further benefit if no reconfiguring of the sailing craft were required when the sailing craft was sailed out of a water body onto land or off of land into a body of water. Because sailing sites can be remote, it would be a further benefit to have a sailing craft that was light weight and easily disassembled for transporting to sailing sites.

GENERAL SUMMARY DISCUSSION OF INVENTION

It is thus an object of the invention to provide a sailing craft that includes wheels and inflatable tubes that cooperate to allow the sailing craft to be piloted over land and on water.

It is a further object of the invention to provide a sailing craft that can be sailed out of a water body and onto land without reconfiguring the sailing craft.

It is a still further object of the invention to provide a sailing craft that can be sailed from land into a body of water without reconfiguring the sailing craft.

It is a still further object of the invention to provide a sailing craft that is light weight and easily disassembled for transporting to sailing sites.

It is a still further object of the invention to provide a sailing craft that includes an elongated central tubular frame structure, a left outrigger assembly attached to the forward left side of the central tubular frame structure, a right outrigger assembly attached to the forward right side of the central tubular frame structure, a rudder steering assembly pivotally mounted to the rear center of the tubular frame structure, a left sail supported by the left outrigger assembly, a right sail supported by the right outrigger assembly, and a seat assembly secured to the rearward end of the central tubular frame structure.

It is a still further object of the invention to provide a sailing craft that accomplishes some or all of the above objects in combination.

Accordingly, a sailing craft is provided. The sailing craft includes an elongated central tubular frame structure, a left outrigger assembly attached to the forward left side of the central tubular frame structure, a right outrigger assembly attached to the forward right side of the central tubular frame structure, a rudder steering assembly pivotally mounted to the forward center of the tubular frame structure, a left sail supported by the left outrigger assembly, a right sail supported by the right outrigger assembly, and a seat assembly secured to the rearward end of the central tubular frame structure; the left outrigger assembly including a tubular left outrigger framework, a left mast member secured to the tubular left outrigger framework, a left inflatable outrigger tube attached to the tubular left outrigger framework, and a left rotating skag wheel rotatably mounted within the opening of the left inflatable outrigger tube; the right outrigger assembly including a tubular right outrigger framework, a right mast secured to the tubular right outrigger framework, a right inflatable outrigger tube attached to the tubular right outrigger framework, and a right rotating skag wheel rotatably mounted within the opening of the right inflatable outrigger tube; the rudder steering assembly including a rudder control arm connected to the rear circular rudder keel board rotatably mounted in a pivoting keel board fork assembly, the pivoting keel board fork assembly being in pivotal connection with the central tubular frame structure; the left sail being secured to the left mast; the right sail being secured to the right mast; the seat assembly including a seat, a tubular seat assembly frame, an inflatable seat assembly tube secured to the tubular seat assembly frame, and a rotating seat assembly rudder wheel rotatably mounted within an opening of the inflatable seat assembly tube; the left rotating skag wheel, the right rotating skag wheel and the seat assembly skag wheel rotating about parallel axises; the left rotating skag wheel having a portion thereof extending down past the left inflatable outrigger tube; the right rotating skag wheel having a portion thereof extending down past the right inflatable outrigger tube; the seat assembly rudder wheel having a portion thereof extending down past the inflatable seat assembly tube; the left outrigger framework having a front portion oriented at an angle of between one-hundred-twenty and one-hundred-fifty degrees with respect to a rear portion thereof; the right outrigger framework having a front portion oriented at an angle of between one-hundred-twenty and one-hundred-fifty degrees with respect to a rear portion thereof. If desired the sailing craft can include a number of quick release fastening fittings including connecting pins or the like to allow the central tubular frame structure to be rapidly disconnected and connected to the left outrigger assembly, the right outrigger assembly, the rudder steering assembly, the left and rights masts, and/or the seat assembly. In addition, the left inflatable outrigger tube, the right inflatable outrigger tube and the inflatable seat assembly tube are preferably a vehicle tire inner tube, and more preferably a motorcycle tire inner tube.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
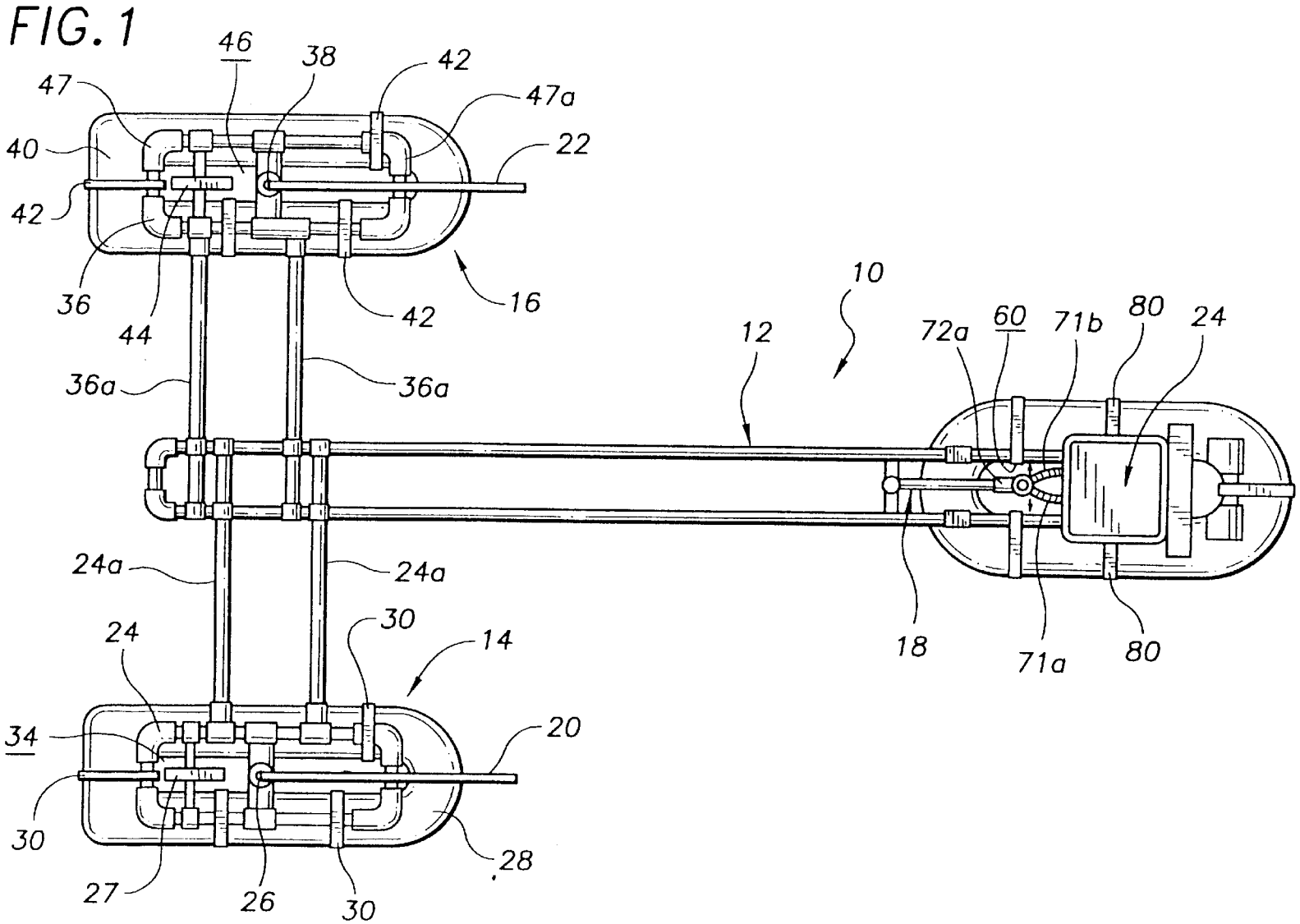
FIG. 1 is a top plan view of an exemplary embodiment of the sailing craft of the present invention showing the central tubular frame structure; the left outrigger assembly including the tubular left outrigger framework, the left mast member secured to the tubular left outrigger framework, the left inflatable outrigger tube attached to the tubular left outrigger framework, and the left rotating skag wheel rotatably mounted within the opening of the left inflatable outrigger tube; the right outrigger assembly including the tubular right outrigger framework, the right mast secured to the tubular right outrigger framework, the right inflatable outrigger tube attached to the tubular right outrigger framework, and the right rotating skag wheel rotatably mounted within the opening of the right inflatable outrigger tube; the rudder steering assembly, the rudder control arm and the circular udder keel board rotatably mounted in the pivoting keel board fork assembly; the left sail secured to the left mast; the right sail secured to the right mast; and the seat assembly secured to the rearward end of the central tubular frame structure and including the seat, the tubular seat assembly frame, the inflatable seat assembly tube, and the rotating seat assembly pivoting rudder wheel rotatably mounted within the opening of the inflatable seat assembly tube.

FIG. 1 shows an exemplary embodiment of the sailing craft of the present invention, generally designated 10, with the mast support struts and control wires removed for clarity. In this embodiment sailing craft 10 includes an elongated central tubular frame structure, generally designated 12; a left outrigger assembly, generally designated 14, attached to the forward left side of the central tubular frame structure 12; a right outrigger assembly, generally designated 16, attached to the forward right side of the central tubular frame structure 12; a rudder steering assembly, generally designated 18, pivotally mounted to the rear center of the tubular frame structure 12; a left sail 20 supported by left outrigger assembly 14; a right sail 22 supported by right outrigger assembly 22; and a seat assembly, generally designated 24, secured to the rearward end of central tubular frame structure 12.

Figure 2:
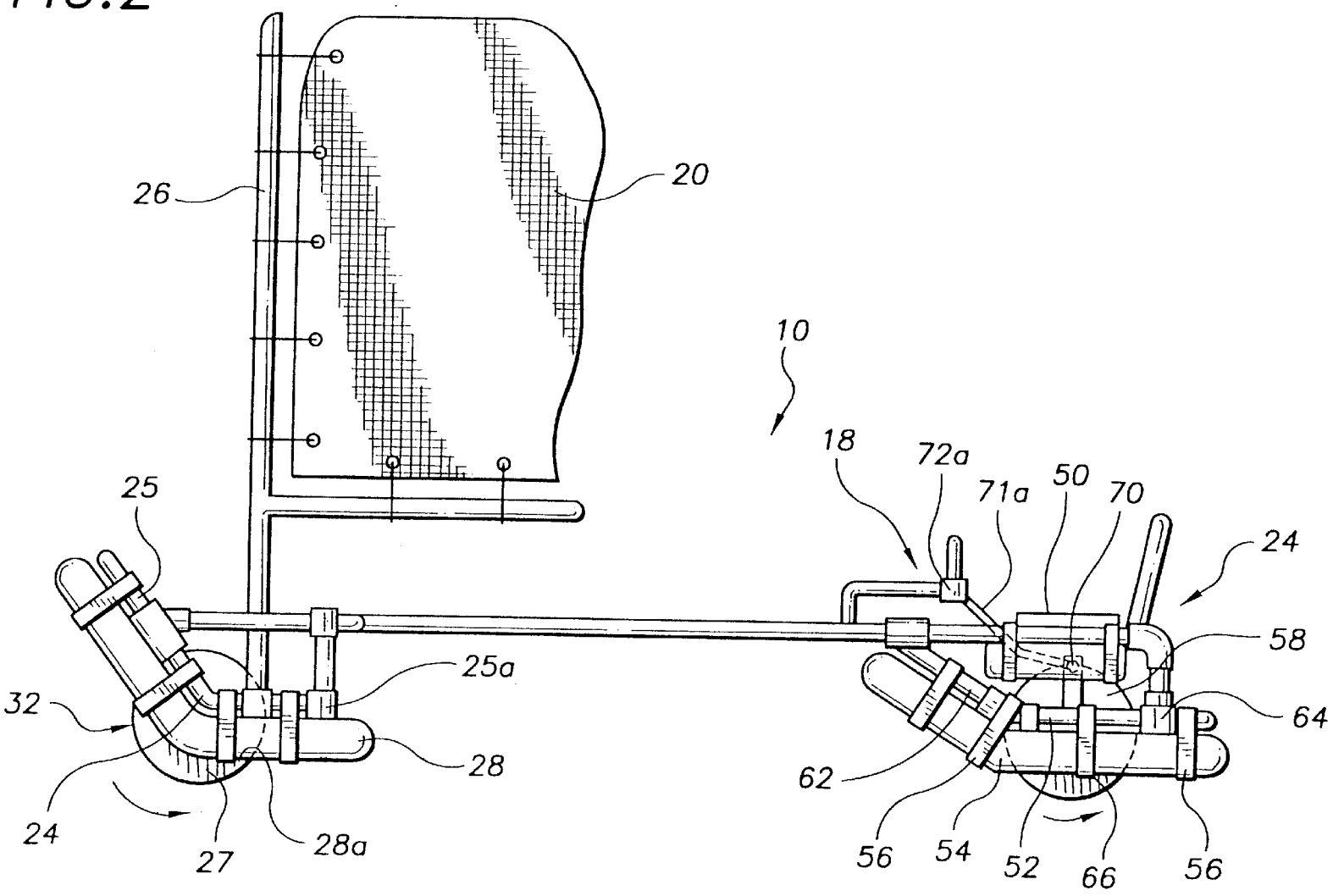
FIG. 2 is a left side plan view of the exemplary embodiment of the sailing craft of FIG. 1 showing the central tubular frame structure; the left outrigger assembly including the tubular left outrigger framework, the left mast member secured to the tubular left outrigger framework, the left inflatable outrigger tube attached to the tubular left outrigger framework with the forward left framework portion oriented at a one-hundred-thirty-five degree angle with respect to the rear left framework portion, and the left rotating skag wheel rotatably mounted within the opening of the left inflatable outrigger tube; the rudder steering assembly including the elongated rudder control arm and the circular rudder keel board rotatably mounted in the pivoting keel board fork assembly; the left sail secured to the left mast; and the seat assembly secured to the rearward end of the central tubular frame structure and including the seat, the tubular seat assembly frame, the inflatable seat assembly tube, and the rotating seat assembly skag wheel rotatably mounted within the opening of the inflatable seat assembly tube.

Elongated central tubular frame structure 12 is constructed from lengths of PVC plastic tubing, although other types of tubing, such as aluminum, can be used without departing from the spirit and scope of the invention taught herein. Left outrigger assembly 14 includes a tubular left outrigger framework 24 constructed from PVC plastic tubing and having two left outrigger struts 24*a,* a left mast member 26 (see also FIG. 2) secured to tubular left outrigger framework 24, a left inflatable outrigger tube 28 attached to tubular left outrigger framework 24 with a number of straps 30, and a left rotating skag wheel 32 that is rotatably mounted within an opening 34 of left inflatable outrigger tube 28. In this embodiment left inflatable outrigger tube 28 is a motorcycle tire inner tube. With reference to FIG. 2, a front portion 25 of tubular left outrigger framework 24 is oriented at an angle of approximately one-hundred-thirty-five degrees with respect to a rear portion 25*a* thereof to provide a shock absorber effect against rough waves and to provide lift. Left rotating skag wheel 32 is rotatably mounted within opening 34 (FIG. 1) such that a portion 27 thereof extends past the lower edge 28*a* of left inflatable outrigger tube 28 to provide a rolling surface when sailing craft 10 is sailed on land. FIG. 2 also shows left mast 26 and sail 20 more clearly.

With reference back to FIG. 1, right outrigger assembly 16 is a mirror image of left outrigger assembly 14 and includes a tubular right outrigger framework 36 constructed from PVC plastic tubing having two right outrigger struts 36*a,* a right mast member 38 secured to tubular right outrigger framework 36, a right inflatable outrigger tube 40 that is attached to tubular right outrigger framework 36 with a number of straps 42, and a right rotating skag wheel 44 that is rotatably mounted within an opening 46 of right inflatable outrigger tube 40. In this embodiment right inflatable outrigger tube 40 is a motorcycle tire inner tube. A front portion 47 of tubular right outrigger framework 36 is oriented at an angle of approximately one-hundred-thirty-five degrees with respect to a rear portion 47*a* thereof to provide a shock absorber effect against rough waves and to provide lift. Right rotating skag wheel 44 is rotatably mounted within opening 46 such that a lower portion thereof extends past the lower edge of right inflatable outrigger tube 40 to provide a rolling surface when sailing craft 10 is sailed on land.

With reference once again to FIG. 2, seat assembly 24 includes a seat 50, a tubular seat assembly frame 52, an inflatable seat assembly tube 54 secured to tubular seat assembly frame 52 with a number of straps 56, and a pivoting rotating seat assembly rudder wheel 58 that is rotatably mounted within an opening 60 (FIG. 1) of inflatable seat assembly tube 54. In this embodiment inflatable seat assembly tube 54 is a motorcycle tire inner tube. A front portion 62 of tubular seat assembly frame 52 is oriented at an angle of approximately one-hundred-thirty-five degrees with respect to a rear portion 64 thereof to provide a shock absorber effect against rough waves and to provide lift. Rotating seat assembly rudder wheel 58 is rotatably mounted within opening 60 (FIG. 1) such that a lower portion 66 thereof extends past the lower edge of inflatable seat assembly tube 54 to provide an additional rolling surface when sailing craft 10 is sailed on land. Left rotating skag wheel 32, right rotating skag wheel 44 and seat assembly rudder wheel 58 rotate about parallel axis when sailing craft 10 is traveling along a straight line path.

Figure 3:
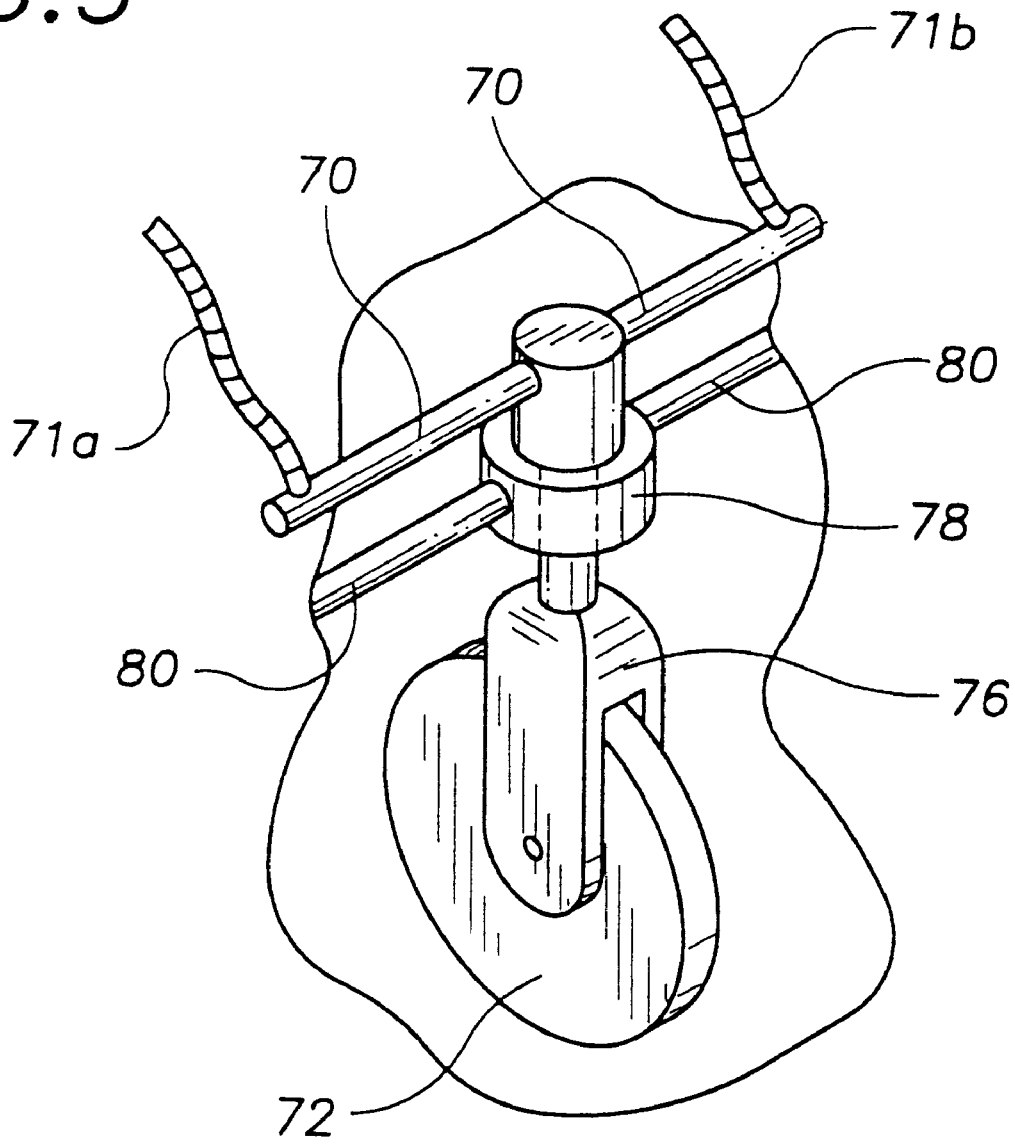
FIG. 3 is a perspective view of the rudder steering assembly including a section of the rudder control arm and the circular rudder keel board rotatably mounted in the rear pivoting keel board fork assembly, the pivoting keel board fork assembly being pivotally mounted in a support hub supported by a cross member of the rear portion of the central tubular framework structure.

Rudder steering assembly 18 includes two steering cables 71*a*,71*b* that are secured between a pivoting steering member 72*a*, a rudder control arm 70 and a circular rudder keel board 66 rotatably mounted, with reference now to FIG. 3, in a pivoting keel board fork assembly 76. The pivoting keel board fork assembly 76 is pivotally mounted in a support hub 78 supported by a cross member 80 of central tubular framework structure 12.

It can be seen from the preceding description that a sailing craft has been provided that includes wheels and inflatable tubes that cooperate to allow the sailing craft to be piloted over land and on water; that can be sailed out of a water body and onto land without reconfiguring the sailing craft; that can be sailed from land into a body of water without reconfiguring the sailing craft; that is light weight; and that includes an elongated central tubular frame structure, a left outrigger assembly attached to the forward left side of the central tubular frame structure, a right outrigger assembly attached to the forward right side of the central tubular frame structure, a rudder steering assembly pivotally mounted to the rear center of the tubular frame structure, a left sail supported by the left outrigger assembly, a right sail supported by the right outrigger assembly, and a seat assembly secured to the rearward end of the central tubular frame structure.

It is noted that the embodiment of the sailing craft described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A sailing craft comprising:

an elongated central tubular frame structure;

a left outrigger assembly attached to a forward left side of said central tubular frame structure;

a right outrigger assembly attached to a forward right side of said central tubular frame structure;

a rudder steering assembly pivotally mounted to a rear center of said tubular frame structure;

a left sail supported by said left outrigger assembly;

a right sail supported by said right outrigger assembly; and a seat assembly secured to said rearward end of said central tubular frame structure;

said left outrigger assembly including a tubular left outrigger framework, a left mast member secured to said tubular left outrigger framework, a left inflatable outrigger tube attached to said tubular left outrigger framework, and a left rotating skag wheel rotatably mounted within an opening of said left inflatable outrigger tube;

said right outrigger assembly including a tubular right outrigger framework, a right mast secured to said tubular right outrigger framework, a right inflatable outrigger tube attached to said tubular right outrigger framework, and a right rotating skag wheel rotatably mounted within an opening of said right inflatable outrigger tube;

said rudder steering assembly including a rudder control arm and a circular seat assembly skag wheel rotatably mounted in a pivoting keel board fork assembly, said pivoting keel board fork assembly being in pivotal connection with said central tubular frame structure;

said left sail being secured to said left mast;

said right sail being secured to said right mast;

said seat assembly including a seat, a tubular seat assembly frame, an inflatable seat assembly tube secured to said tubular seat assembly frame, and said seat assembly skag wheel being rotatably mounted within an opening of said inflatable seat assembly tube;

said left rotating skag wheel, said right rotating skag wheel and said seat assembly skag wheel rotating about parallel axes;

said left rotating skag wheel having a portion thereof extending down past said left inflatable outrigger tube;

said right rotating skag wheel having a portion thereof extending down past said right inflatable outrigger tube;

said seat assembly skag wheel having a portion thereof extending down past said inflatable seat assembly tube.

2. The sailing craft of claim 1, wherein:

said elongated central tubular frame structure is constructed from lengths of tubing.

3. The sailing craft of claim 1, wherein:

said left inflatable outrigger tube is a vehicle tire inner tube;

said right inflatable outrigger tube is a vehicle tire inner tube; and said inflatable seat assembly tube is a vehicle tire inner tube.

4. The sailing craft of claim 3 wherein:

said left inflatable outrigger tube is a motorcycle tire inner tube;

said right inflatable outrigger tube is a motorcycle tire inner tube; and said inflatable seat assembly tube is a motorcycle tire inner tube.

5. The sailing craft of claim 1 wherein:

said left outrigger framework has a front portion oriented at an angle of between one-hundred-twenty and one-hundred-fifty degrees with respect to a rear portion thereof; and said right outrigger framework has a front portion oriented at an angle of between one-hundred-twenty and one-hundred-fifty degrees with respect to a rear portion thereof.

6. The sailing craft of claim 2, wherein:

said left inflatable outrigger tube is a vehicle tire inner tube;

said right inflatable outrigger tube is a vehicle tire inner tube; and said inflatable seat assembly tube is a vehicle tire inner tube.

7. The sailing craft of claim 6 wherein:

said left inflatable outrigger tube is a motorcycle tire inner tube;

said right inflatable outrigger tube is a motorcycle tire inner tube; and said inflatable seat assembly tube is a motorcycle tire inner tube.

8. The sailing craft of claim 2 wherein:

said left outrigger framework has a front portion oriented at an angle of between one-hundred-twenty and one-hundred-fifty degrees with respect to a rear portion thereof; and said right outrigger framework has a front portion oriented at an angle of between one-hundred-twenty and one-hundred-fifty degrees with respect to a rear portion thereof.

9. The sailing craft of claim 6 wherein:

said left outrigger framework has a front portion oriented at an angle of between one-hundred-twenty and one-hundred-fifty degrees with respect to a rear portion thereof; and said right outrigger framework has a front portion oriented at an angle of between one-hundred-twenty and one-hundred-fifty degrees with respect to a rear portion thereof.

10. The sailing craft of claim 7 wherein:

said left outrigger framework has a front portion oriented at an angle of between one-hundred-twenty and one-hundred-fifty degrees with respect to a rear portion thereof; and said right outrigger framework has a front portion oriented at an angle of between one-hundred-twenty and one-hundred-fifty degrees with respect to a rear portion thereof.

11. The sailing craft of claim 3 wherein:

said left outrigger framework has a front portion oriented at an angle of between one-hundred-twenty and one-hundred-fifty degrees with respect to a rear portion thereof; and said right outrigger framework has a front portion oriented at an angle of between one-hundred-twenty and one-hundred-fifty degrees with respect to a rear portion thereof.

12. The sailing craft of claim 4 wherein:

said left outrigger framework has a front portion oriented at an angle of between one-hundred-twenty and one-hundred-fifty degrees with respect to a rear portion thereof; and said right outrigger framework has a front portion oriented at an angle of between one-hundred-twenty and one-hundred-fifty degrees with respect to a rear portion thereof.

* * * * *